US012733743B2

(12) United States Patent
Chen et al.

(10) Patent No.: US 12,733,743 B2
(45) Date of Patent: Sep. 15, 2026

(54) LINKAGE MECHANISM FOR THREE-SECTION SOFA BED

(71) Applicant: JIAXING REST FURNITURE & APPLIANCE CO., LTD., Jiaxing (CN)

(72) Inventors: Jiguan Chen, Jiaxing (CN); Bin Chen, Jiaxing (CN); Qiangqiang Wu, Jiaxing (CN); Baoli Zhang, Jiaxing (CN); Chong Ma, Jiaxing (CN)

(73) Assignee: JIAXING REST FURNITURE & APPLIANCE CO., LTD., Jiaxing (CN)

( * ) Notice: Subject to any disclaimer, the term of this patent is extended or adjusted under 35 U.S.C. 154(b) by 65 days.

(21) Appl. No.: 19/026,613

(22) Filed: Jan. 17, 2025

(65) Prior Publication Data

US 2026/0060435 A1 Mar. 5, 2026

(30) Foreign Application Priority Data

Aug. 28, 2024 (CN) ..... 202411186185.X

(51) Int. Cl.
*A47C 17/13* (2006.01)

(52) U.S. Cl.
CPC ..... *A47C 17/132* (2013.01)

(58) Field of Classification Search
CPC ... A47C 17/132; A47C 17/2076; A47C 17/86; A47C 19/021; A47C 19/122; A47C 17/04; A47C 17/17; A47C 17/1655; A47C 17/175; A47C 17/1753; A47C 17/2073; A47C 17/213; A47C 17/1756; A47C 17/225
See application file for complete search history.

(56) References Cited

U.S. PATENT DOCUMENTS 1,743,216 A * 1/1930 Honsinger ..... A47C 17/22 5/56
2021/0315387 A1* 10/2021 Williams ..... A47C 17/161

* cited by examiner

*Primary Examiner* — J. T. Newton
(74) *Attorney, Agent, or Firm* — Bayramoglu Law Offices LLC

(57) ABSTRACT

A linkage mechanism for a three-section sofa bed is provided. The linkage mechanism includes a first link assembly, a second link assembly, a third link assembly, and a locking assembly, where the first link assembly includes one side pivoted to a front sofa cushion and the other side pivoted to a fixed base frame of a sofa frame; the first link assembly is provided with a locking hole; the second link assembly includes one end pivoted to a middle sofa cushion and the other end pivoted to a middle segment of the first link assembly; the third link assembly includes one side pivoted to a rear sofa cushion and the other side pivoted to a pivot position of the first link assembly pivoted to the fixed base frame; the locking assembly is located at a side of the first link assembly close to the front sofa cushion.

10 Claims, 10 Drawing Sheets

LINKAGE MECHANISM FOR THREE-SECTION SOFA BED

CROSS-REFERENCE TO THE RELATED APPLICATIONS

This application is based upon and claims priority to Chinese Patent Application No. 202411186185.X, filed on Aug. 28, 2024, the entire contents of which are incorporated herein by reference.

TECHNICAL FIELD

The present disclosure relates to the technical field of beds, and in particular to a linkage mechanism for a three-section sofa bed.

BACKGROUND

Modern living arrangements advocate simplicity. With the acceleration of social development and the continuous increase of population, the limitation of living space is becoming increasingly apparent. In this context, multifunctional furniture, for example sofa bed, has gradually become the choice of the public. Sofa beds are a necessity for small houses to meet the needs of occasional overnight guests. Normally, a sofa bed can be placed in the living room or study to provide a seating function. In case there is an overnight guest, the sofa bed is unfolded and covered with bedding, thereby converting the sofa bed into a sleeping bed. Sofa beds are also suitable for ordinary houses, such as one with three bedrooms, one living room, and one dining room, to help the host cope with occasional visits from more than one overnight guest in addition to the guest bed. Currently, there are various types of sofa beds on the market, with various ways, such as folding, flipping, and extension, to convert sofa beds between sofas and beds. These sofa beds use various connection mechanisms, which are usually time-consuming, strenuous, and inconvenient. In addition, due to the lack of a locking structure for the conversion between the sofa and bed, the sofa bed is easily unstable when being unfolded.

SUMMARY

In order to solve the above technical problems, an embodiment of the present disclosure provides a linkage mechanism for a three-section sofa bed. Specifically, the present disclosure adopts the following technical solution.

A linkage mechanism for a three-section sofa bed includes a first link assembly, a second link assembly, a third link assembly, and a locking assembly, where the first link assembly includes one side pivoted to a front sofa cushion and the other side pivoted to a fixed base frame of a sofa frame; the first link assembly is provided with a locking hole; the front sofa cushion is folded and stored inside the sofa frame or unfolded at one side of a middle sofa cushion through the linkage rotation of the first link assembly; the second link assembly includes one end pivoted to the middle sofa cushion and the other end pivoted to a middle segment of the first link assembly; the first link assembly drives the second link assembly to rotate, thereby allowing the middle sofa cushion to be folded and stored inside the sofa frame or unfolded at one side of a rear sofa cushion; the third link assembly includes one side pivoted to the rear sofa cushion and the other side pivoted to a pivot position of the first link assembly pivoted to the fixed base frame; the first link assembly drives the third link assembly to rotate, thereby allowing the rear sofa cushion to rise and fall; the locking assembly is located at a side of the first link assembly close to the front sofa cushion; the locking assembly includes a locking rod; the locking rod corresponds to the locking hole; and when the front sofa cushion is unfolded at one side of the middle sofa cushion through the linkage rotation of the first link assembly, an insertion end of the locking rod of the locking assembly is inserted into the locking hole to prevent the first link assembly from rotating again.

In an embodiment, the first link assembly includes a first link and a second link; the first link includes one end pivoted to the front sofa cushion and the other end pivoted to the fixed base frame; the locking assembly is located at a side of the first link close to the front sofa cushion; the second link corresponds to the first link; the second link corresponds to the first link and includes one end pivoted to the front sofa cushion and the other end pivoted to the fixed base frame; the locking hole is located on the second link; the front sofa cushion is folded and stored inside the sofa frame or unfolded at one side of the middle sofa cushion through the linkage rotation of the first link and the second link; and when the front sofa cushion is unfolded at one side of the middle sofa cushion, the insertion end of the locking rod of the locking assembly is inserted into the locking hole to prevent the first link and the second link from rotating.

In an embodiment, when the front sofa cushion is unfolded at one side of the middle sofa cushion through the linkage rotation of the first link and the second link, the side of the first link close to the front sofa cushion is provided with a bearing segment that extends along a length direction of the front sofa cushion; the locking assembly is located on the bearing segment; a pivot end of the second link pivoted to the front sofa cushion extends along the length direction of the front sofa cushion; and the locking hole is located at one end of the second link close to the locking assembly.

In an embodiment, the locking assembly includes a fixed member and a first elastic member; the fixed member is fixedly provided on the bearing segment; the locking rod is threaded through the fixed member; the locking rod is provided with a stop member close to one side of the insertion end of the locking rod; the first elastic member is sleeved on the locking rod; two ends of the first elastic member abut against the stop member and the fixed member, respectively; and the first elastic member is configured to drive the insertion end of the locking rod to be inserted into the locking hole.

In an embodiment, two sides of the locking hole of the second link are arc-shaped; when the front sofa cushion is unfolded at one side of the middle sofa cushion through the linkage rotation of the first link and the second link, the insertion end of the locking rod slides into the locking hole through arc-shaped segments at the two sides of the locking hole of the second link.

In an embodiment, the locking assembly further includes an unlocking protrusion; the unlocking protrusion is located on the front sofa cushion and corresponds to the locking rod; an end of the locking rod opposite to the insertion end is provided with a pull rod; the pull rod abuts against a side of the unlocking protrusion facing away from the locking hole; and the pull rod drives the insertion end to separate from the locking hole.

In an embodiment, when the front sofa cushion is folded and stored inside the sofa frame through the linkage rotation of the first link and the second link, the bearing segment of the first link drives the pull rod of the locking rod to separate from the unlocking protrusion; and the first elastic member drives the insertion end of the locking rod to reset.

In an embodiment, the second link assembly includes a third link; the third link includes one end pivoted to the middle segment of the first link and the other end pivoted to the middle sofa cushion; the middle sofa cushion is pivoted to a middle segment of the second link; and through the third link, the first link and the second link drive the middle sofa cushion to be folded and stored inside the sofa frame or unfolded at one side of the rear sofa cushion.

In an embodiment, the third link assembly includes a fourth link and a fifth link; the fourth link and the fifth link correspond and are parallel to each other; one end of the fourth link and one end of the fifth link are pivoted to the rear sofa cushion; the other end of the fourth link is pivoted to a pivot position of the second link pivoted to the fixed base frame; the other end of the fifth link is pivoted to the fixed base frame; and through the linkage rotation of the fourth link and the fifth link, the second link assembly drives the rear sofa cushion to rise and fall.

In an embodiment, the linkage mechanism for a three-section sofa bed further includes a second elastic member; the second elastic member includes one end pivoted to the fixed base frame and the other end pivoted to the rear sofa cushion; and the second elastic member is configured to provide assistance when the front sofa cushion is folded and stored, or unfolded.

In the embodiments of the present disclosure, the front sofa cushion is folded and stored inside the sofa frame or unfolded at one side of the middle sofa cushion through the linkage rotation of the first link assembly. The first link assembly drives the second link assembly, allowing the middle sofa cushion to be folded and stored inside the sofa frame or unfolded at one side of the rear sofa cushion, and drives the third link assembly, allowing the rear sofa cushion to rise and fall. The design realizes the one-step unfolding or folding of the three-section sofa bed, featuring easy operation, small structural volume, and low logistics costs. After the front sofa cushion is unfolded, the insertion end of the locking rod of the locking assembly is inserted into the locking hole to prevent the first link assembly from rotating again, thereby locking the linkage mechanism. The design prevents the front sofa cushion from being folded due to excessive loads of the middle sofa cushion and the rear sofa cushion, greatly improving product safety. Meanwhile, in the present disclosure, the linkage mechanism for a three-section sofa bed adopts the mounting form of three linkage assemblies, reducing packaging space and facilitating transportation.

BRIEF DESCRIPTION OF THE DRAWINGS

The drawings described herein are provided for further understanding of the present disclosure, and constitute a part of the present disclosure. The exemplary embodiments of this application and illustrations thereof are intended to explain the present disclosure, but do not constitute inappropriate limitations to the present disclosure. Figures.

DETAILED DESCRIPTION OF THE EMBODIMENTS

The technical solutions in the embodiments of the present disclosure are clearly and completely described below with reference to the drawings in the embodiments of the present disclosure. Apparently, the described embodiments are merely some rather than all of the embodiments of the present disclosure. All other embodiments obtained by those of ordinary skill in the art based on the embodiments of the present disclosure without creative efforts should fall within the protection scope of the present disclosure.

In addition, terms such as "first" and "second" used herein are not intended to specifically refer to order or sequence or to limit the scope of the present disclosure. Instead, they are only intended to distinguish components or operations described using the same technical terms.

Figure 1:
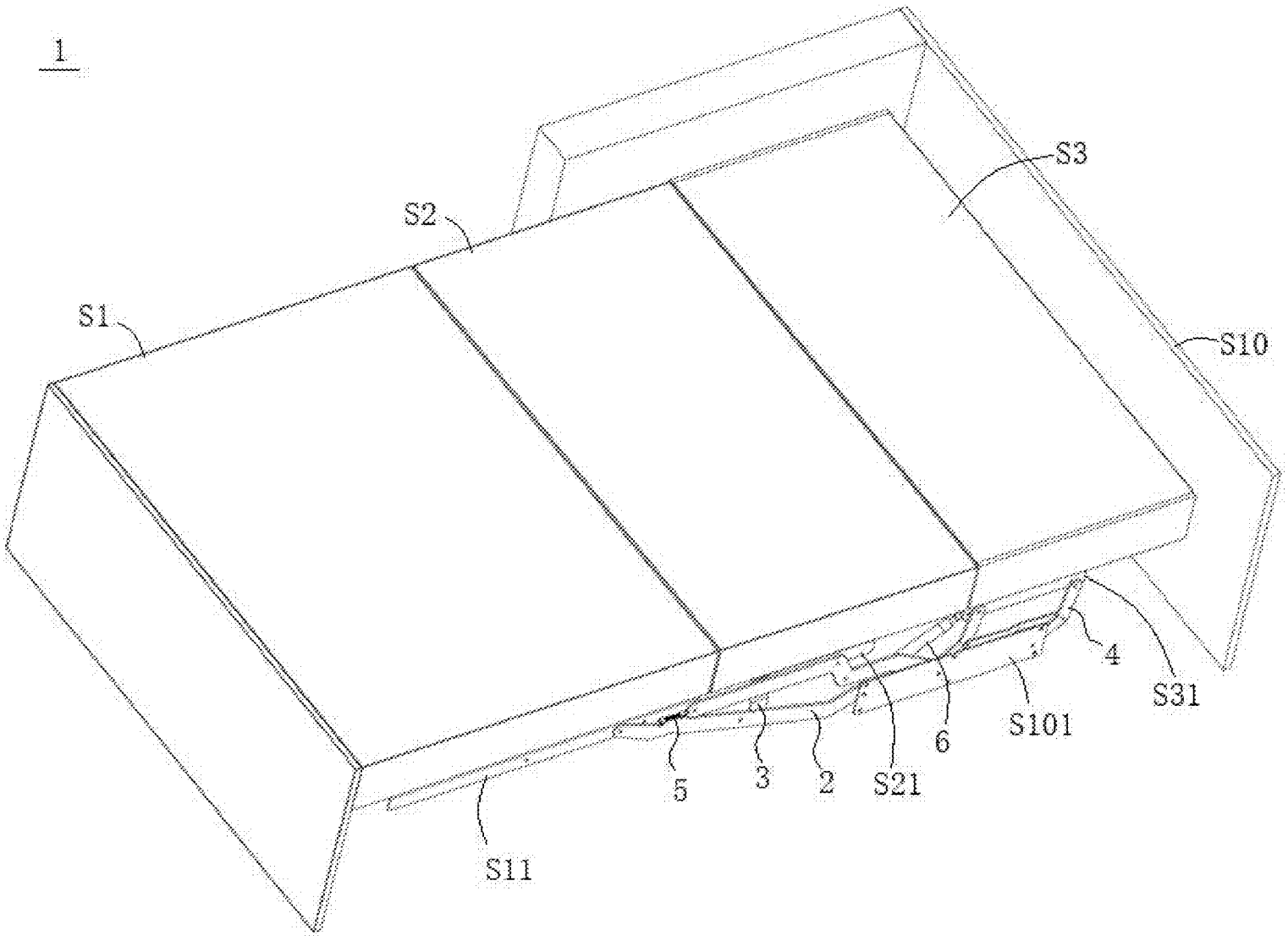
FIG. 1 is a perspective view of a linkage mechanism for a three-section sofa bed in an unfolded state according to the present disclosure.
Figure 2:
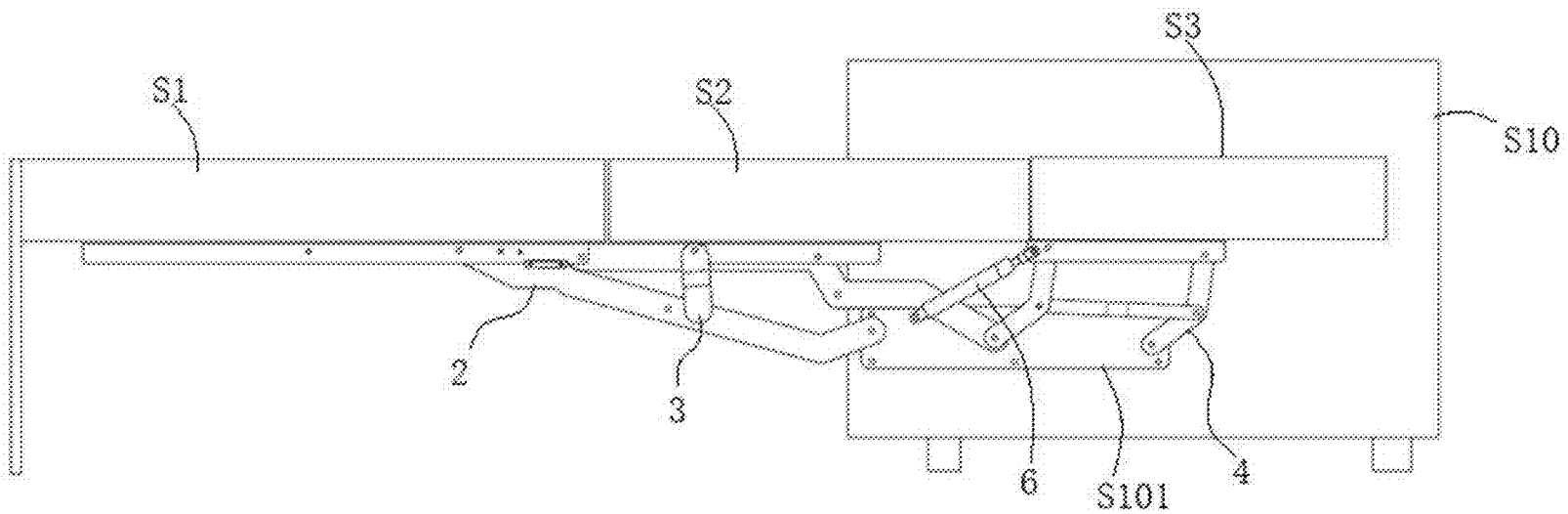
FIG. 2 is a section view of the linkage mechanism for a three-section sofa bed in the unfolded state according to the present disclosure.
Figure 3:
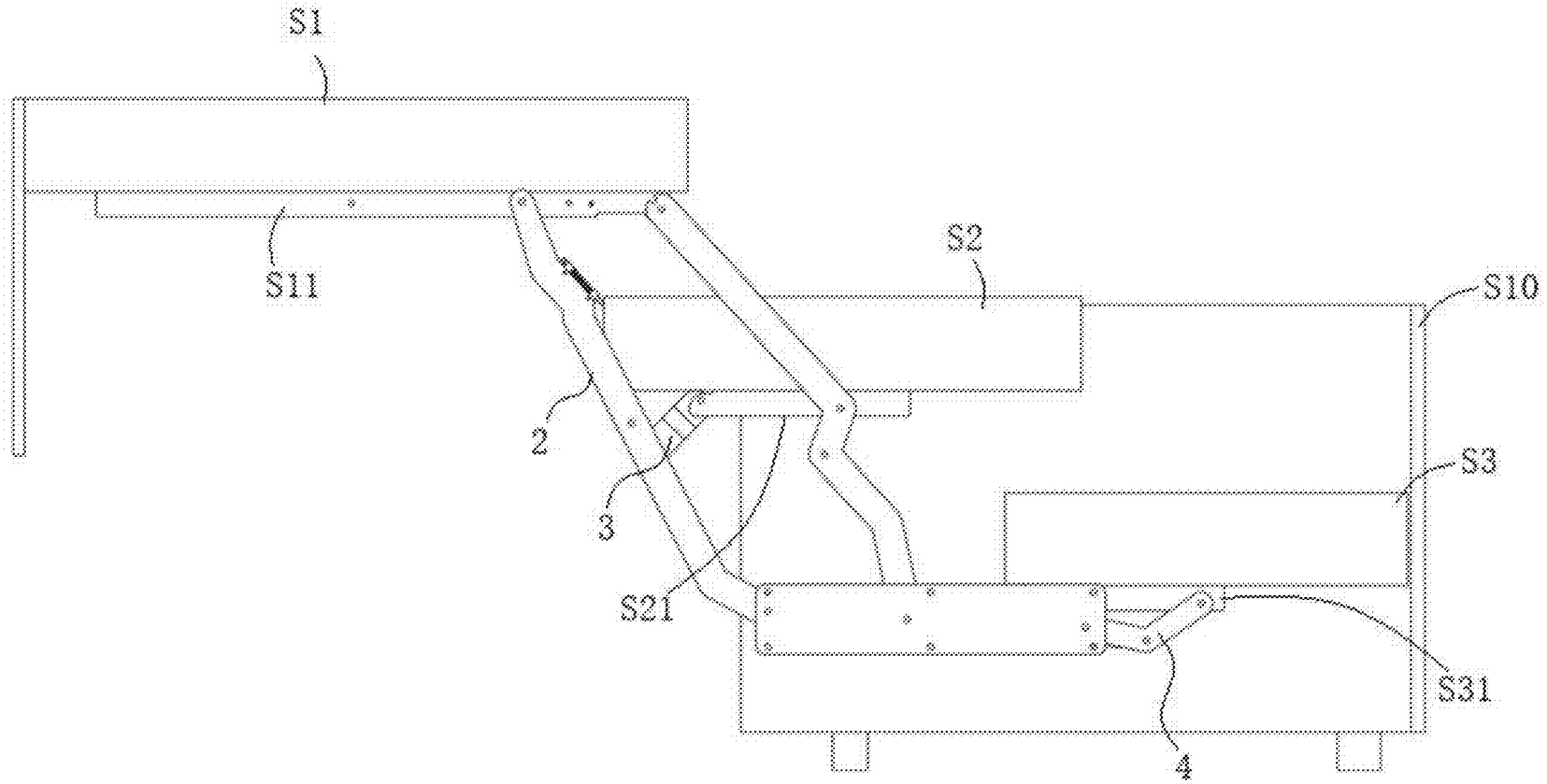
FIG. 3 is a section view of the linkage mechanism for a three-section sofa bed in a semi-unfolded state according to the present disclosure.
Figure 4:
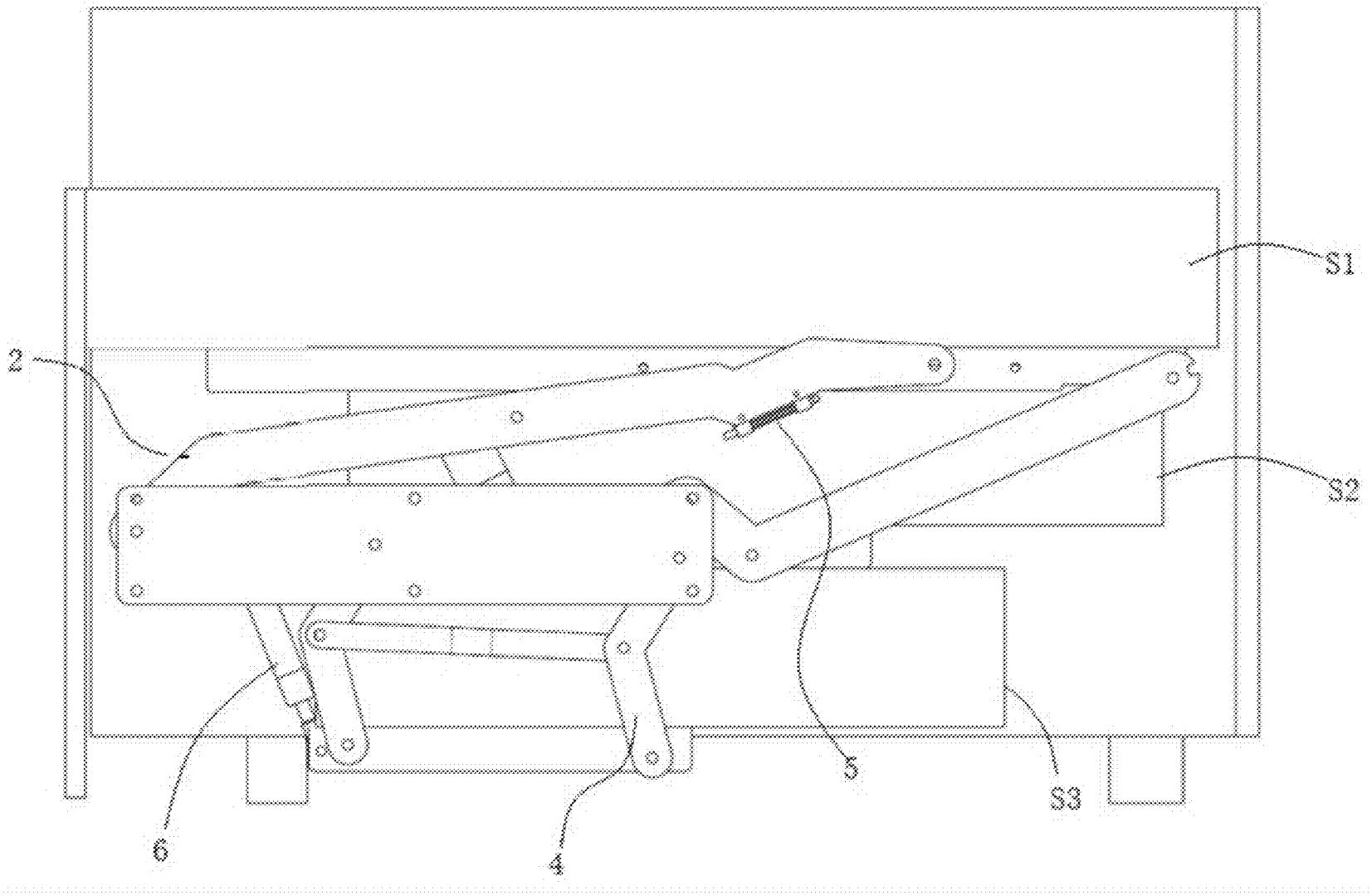
FIG. 4 is a section view of the linkage mechanism for a three-section sofa bed in a folded state according to the present disclosure.
Figure 5:
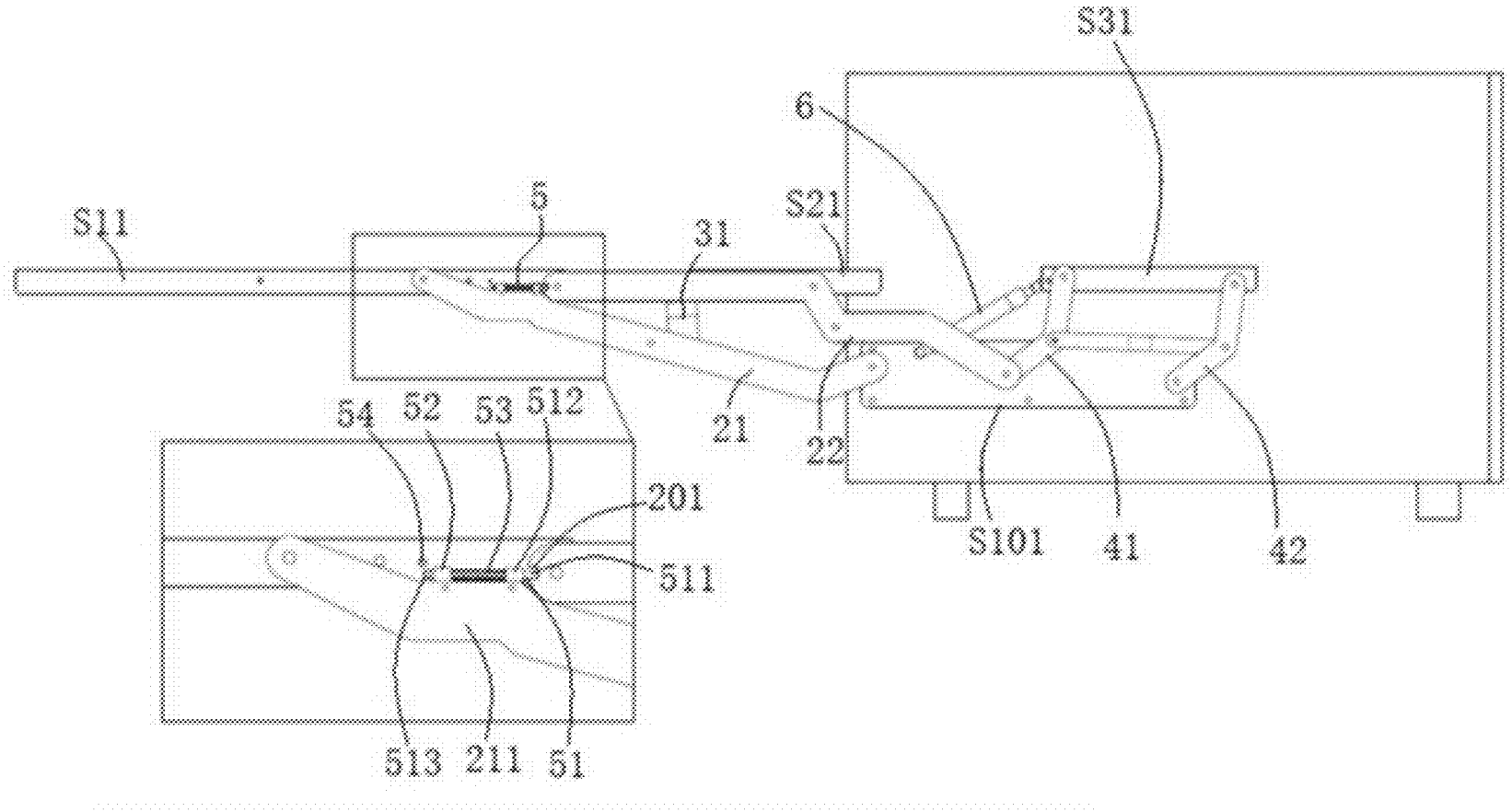
FIG. 5 is a schematic diagram of an iron frame of the linkage mechanism for a three-section sofa bed in the unfolded state according to the present disclosure.

FIG. 1 is a perspective view of a linkage mechanism for a three-section sofa bed in an unfolded state according to the present disclosure; FIG. 2 is a section view of the linkage mechanism for a three-section sofa bed in the unfolded state; FIG. 3 is a section view of the linkage mechanism for a three-section sofa bed in a semi-unfolded state; FIG. 4 is a section view of the linkage mechanism for a three-section sofa bed in a folded state; and FIG. 5 is a schematic diagram of an iron frame of the linkage mechanism for a three-section sofa bed in the unfolded state according to the present disclosure. As shown in FIGS. 1 to 5, in this implementation, linkage mechanism 1 for a three-section sofa bed includes first link assembly 2, second link assembly 3, third link assembly 4, and locking assembly 5. One side of the first link assembly 2 is pivoted to front sofa cushion S1, and the other side of the first link assembly 2 is pivoted to fixed base frame S101 of sofa frame S10. As shown in FIG. 3, an upper side of the first link assembly 2 is pivoted to first iron frame S11 below the front sofa cushion S1, and a lower side of the first link assembly 2 is pivoted to the fixed base frame S101. The first link assembly 2 is provided with locking hole 201. The front sofa cushion S1 is folded and stored inside the sofa frame S10 or unfolded at one side of middle sofa cushion S2 through the linkage rotation of the first link assembly 2. One end of the second link assembly 3 is pivoted to the middle sofa cushion S2, and the other end of the second link assembly 3 is pivoted to a middle segment of the first link assembly 2. As shown in FIG. 3, an upper side of the second link assembly 3 is pivoted to second iron frame S21 below the middle sofa cushion S2, and a lower side of the second link assembly 3 is pivoted to the middle segment of the first link assembly 2. The first link assembly 2 drives the second link assembly 3 to rotate, thereby allowing the middle sofa cushion S2 to be folded and stored inside the sofa frame S10 or unfolded at one side of a rear sofa cushion.

On the above basis, one side of the third link assembly 4 is pivoted to the rear sofa cushion S3, and the other side of the third link assembly 4 is pivoted to a pivot position of the first link assembly 2 pivoted to the fixed base frame S101. As shown in FIG. 3, an upper side of the third link assembly 4 is pivoted to third iron frame S31 below the rear sofa cushion S3, and a lower side of the third link assembly 4 is pivoted to the fixed base frame S101. The first link assembly 2 drives the third link assembly 4 to rotate, thereby allowing the rear sofa cushion S3 to rise and fall. The locking assembly 5 is located at a side of the first link assembly 2 close to the front sofa cushion S1. The locking assembly 5 includes locking rod 51. The locking rod 51 corresponds to the locking hole 201. The front sofa cushion S1 is unfolded at one side of the middle sofa cushion S2 through the linkage rotation of the first link assembly 2. Insertion end 511 of the locking rod 51 of the locking assembly 5 is inserted into the locking hole 201 to prevent the first link assembly 2 from rotating again, thereby locking the first link assembly 2. When the insertion end 511 of the locking rod 51 is pulled out from the locking hole 201, the first link assembly 2 is unlocked.

As shown in FIGS. 1 to 5, in this implementation, when the linkage mechanism 1 for a three-section sofa bed is unfolded, the front sofa cushion S1 is unfolded at one side of the middle sofa cushion S2 through the linkage rotation of the first link assembly 2. Meanwhile, the first link assembly 2 drives the second link assembly 3, allowing the middle sofa cushion S2 to be unfolded at one side of the rear sofa cushion S3, and drives the third link assembly 4, allowing the rear sofa cushion S3 to rise. Thus, the three-section sofa bed 1 is unfolded. On the contrary, when the linkage mechanism 1 of the three-section sofa bed is folded, the front sofa cushion S1 is folded and stored inside the sofa frame S10 through the linkage rotation of the first link assembly 2. Meanwhile, the first link assembly 2 drives the second link assembly 3, allowing the middle sofa cushion S2 to be folded and stored inside the sofa frame S10, and drives the third link assembly 4, allowing the rear sofa cushion S3 to fall. Thus, the three-section sofa bed 1 is folded. In this implementation, the linkage mechanism 1 for a three-section sofa bed achieves the unfolding or folding of the three-section sofa bed 1 through the linkage rotation of the first link assembly 2, the second link assembly 3, and the third link assembly 4. The design is easy to operate, reduces packaging space, and lowers logistics costs. In this implementation, in the linkage mechanism 1 for a three-section sofa bed, after the front sofa cushion S1 is unfolded, the insertion end 511 of the locking rod 51 of the locking assembly 5 is inserted into the locking hole 201 to prevent the first link assembly 2 from rotating again, thereby locking the linkage mechanism 1. Thus, the front sofa cushion S1 is prevented from being folded due to excessive loads of the middle sofa cushion S2 and the rear sofa cushion S3, greatly improving product safety.

The structure of the linkage mechanism 1 for a three-section sofa bed in this implementation is described in detail. As shown in FIGS. 3 and 5, the first link assembly 2 includes first link 21 and second link 22. One end of the first link 21 is pivoted to the front sofa cushion S1, and the other end of the first link 21 is pivoted to the fixed base frame S101. The locking assembly 5 is located at a side of the first link 21 close to the front sofa cushion S1. The second link 22 corresponds to the first link 21. One end of the second link 22 is pivoted to the front sofa cushion S1, and the other end of the second link 22 is pivoted to the fixed base frame S101. In this implementation, upper ends of the first link 21 and the second link 22 are pivoted to the first iron frame S11, and lower ends of the first link 21 and the second link 22 are pivoted to the fixed base frame S101. The locking hole 201 is located on the second link 22. The front sofa cushion S1 is folded and stored inside the sofa frame S10 or unfolded at one side of the middle sofa cushion S2 through the linkage rotation of the first link 21 and the second link 22. The front sofa cushion S1 is unfolded at one side of the middle sofa cushion S2. The insertion end 511 of the locking rod 51 of the locking assembly 5 is inserted into the locking hole 201 to prevent the first link 21 and the second link 22 from rotating.

As shown in FIG. 5, when the front sofa cushion S1 is unfolded at one side of the middle sofa cushion S2 through the linkage rotation of the first link 21 and the second link 22, the side of the first link 21 close to the front sofa cushion S1 is provided with bearing segment 211 that extends along a length direction of the front sofa cushion S1. The locking assembly 5 is located on the bearing segment 211. A pivot end of the second link 22 pivoted to the front sofa cushion S1 extends along the length direction of the front sofa cushion S1. The locking hole 201 is located at one end of the second link 22 close to the locking assembly 5. The locking assembly 5 drives the locking rod 51 to move towards the locking hole 201, such that the insertion end 511 of the locking rod is inserted into the locking hole 201. In this implementation, the locking assembly 5 includes fixed member 52 and first elastic member 53. The fixed member 52 is fixedly provided on the bearing segment 211. The locking rod 51 is threaded through the fixed member 52. The locking rod 51 is provided with stop member 512 close to one side of the insertion end 511 of the locking rod 51. The first elastic member 53 is sleeved on the locking rod 51. Two ends of the first elastic member 53 abut against the stop member 512 and the fixed member 52, respectively. The first elastic member 53 is configured to drive the insertion end 511 of the locking rod 51 to be inserted into the locking hole 201. The first elastic member 53 is a spring.

Figure 6:
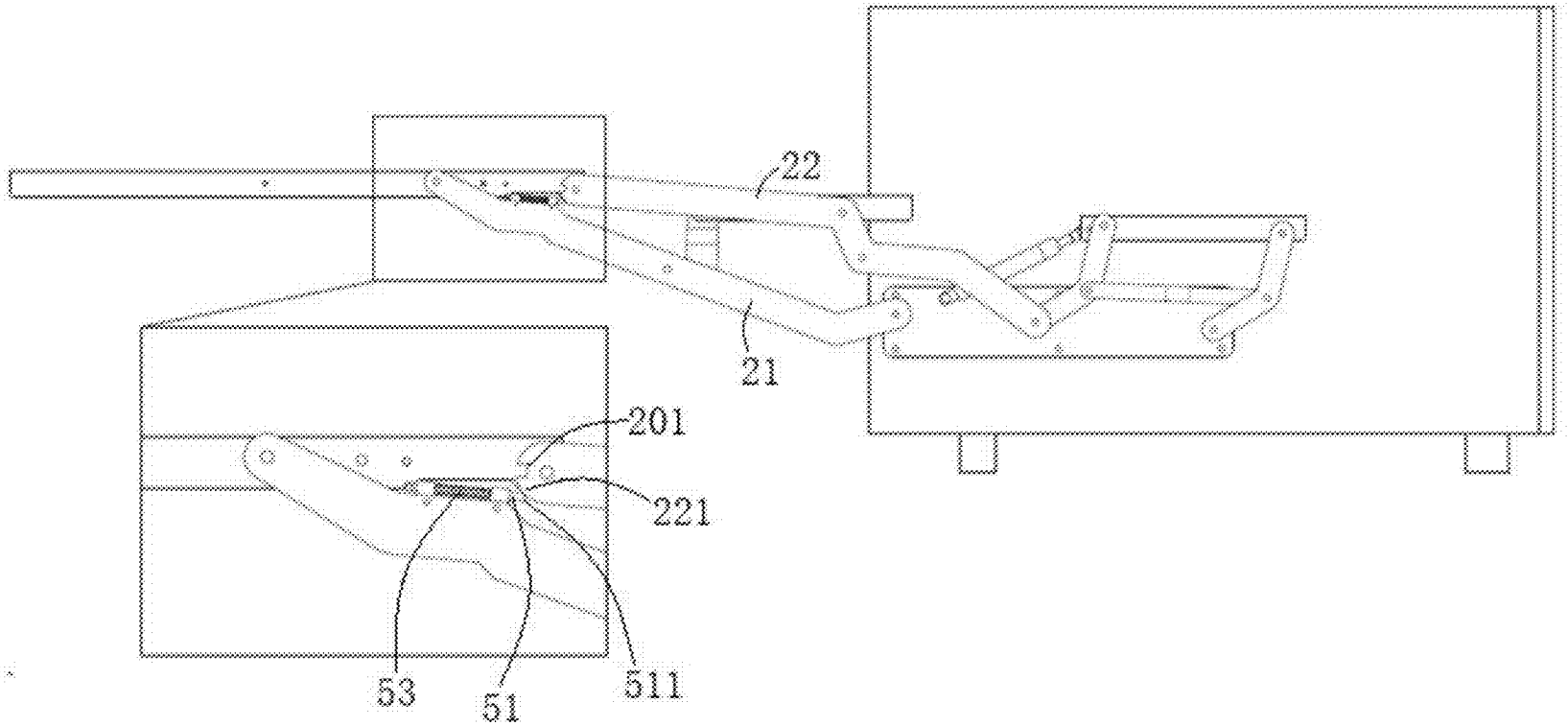
FIG. 6 is a schematic diagram of the iron frame of the three-section sofa bed in an unfolding process according to the present disclosure.

FIG. 6 is a schematic diagram of the iron frame of the three-section sofa bed in an unfolding process according to the present disclosure. As shown in FIGS. 6 and 5, two sides of the locking hole 201 of the second link 22 are arc-shaped. When the front sofa cushion S1 is unfolded at one side of the middle sofa cushion S2 through the linkage rotation of the first link 21 and the second link 22, the insertion end 511 of the locking rod 51 slides into the locking hole 201 through arc-shaped segments 221 at the two sides of the locking hole 201 of the second link 22. Specifically, as shown in FIG. 1, during the linkage rotation of the first link 21 and the second link 22, the arc-shaped segment 221 at a lower side of the locking hole 201 abuts against the insertion end 511 of the locking rod 51, causing the insertion end 511 to move away from one side of the locking hole 201 and compress the first elastic member 53. After the insertion end 511 of the locking rod 51 slides along the arc-shaped segment 221 to correspond to the locking hole 201, as shown in FIG. 5, the first elastic member 53 resets and causes the insertion end 511 of the second link 22 to enter the locking hole 201.

Figure 7:
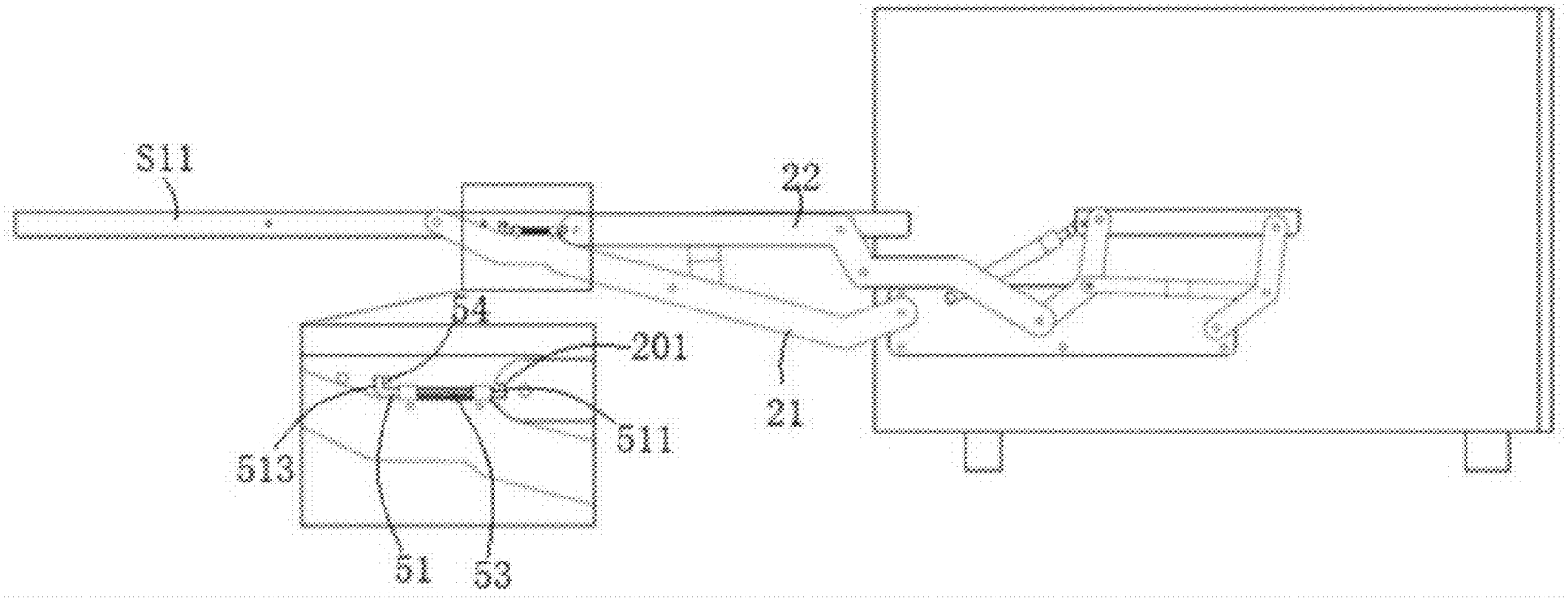
FIG. 7 is a schematic diagram of the iron frame of the three-section sofa bed in an unlocked state according to the present disclosure.
Figure 8:
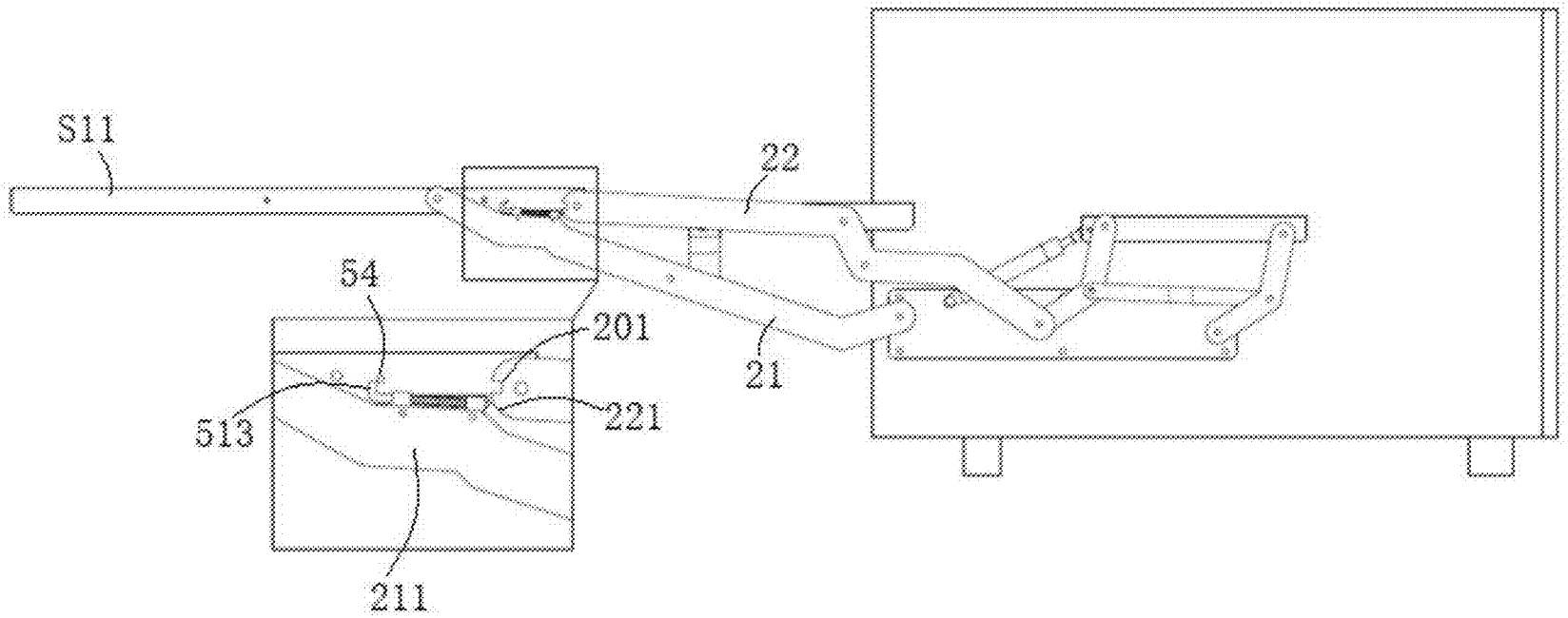
FIGS. 8 and 9 are schematic diagrams of a folding process of the iron frame of the three-section sofa bed according to the present disclosure.
Figure 9:
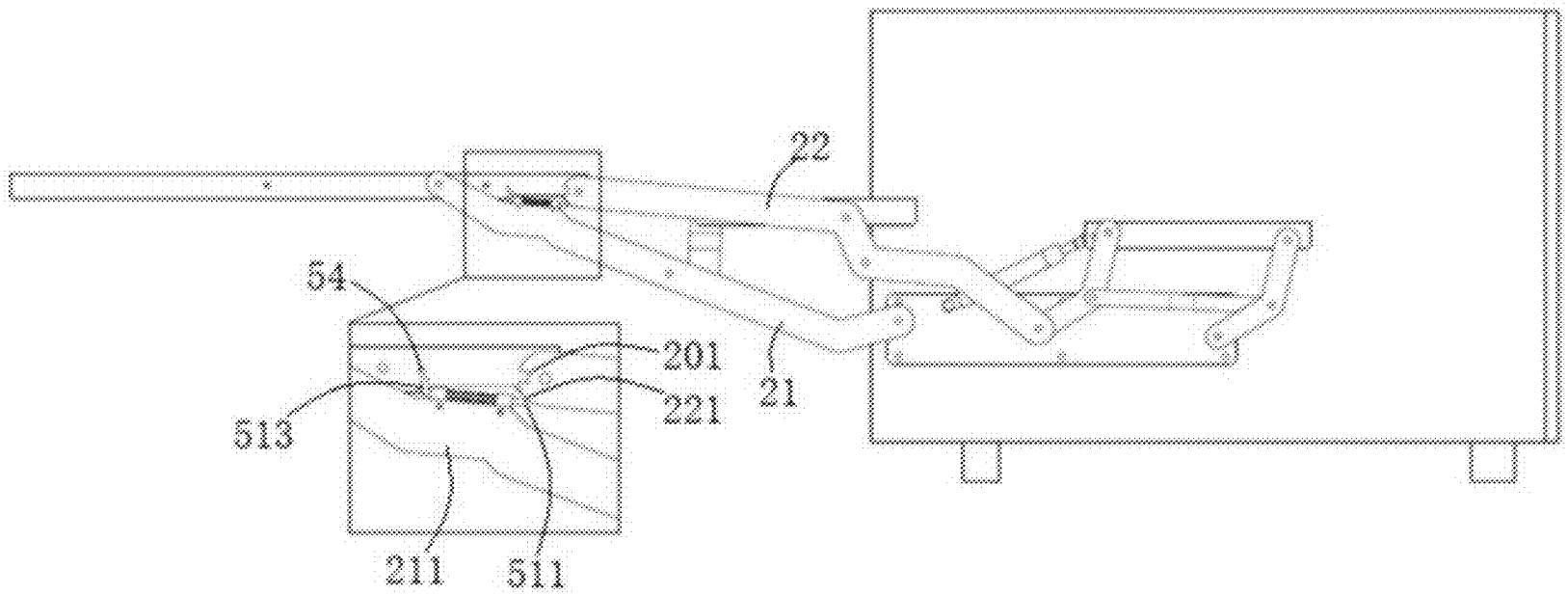

FIG. 7 is a schematic diagram of the iron frame of the three-section sofa bed in an unlocked state according to the present disclosure. As shown in FIGS. 7 and 5, in this implementation, the locking assembly 5 further includes unlocking protrusion 54. The unlocking protrusion 54 is located on the front sofa cushion S1 and corresponds to the locking rod 51. As shown in FIG. 5, the unlocking protrusion 54 is located above the bearing segment 211. An end of the locking rod 51 opposite to the insertion end 511 is provided with pull rod 513. The locking rod 51 and the pull rod 513 form an L shape. The pull rod 513 drives the insertion end 511 of the locking rod 51 to move away from one side of the locking hole 201, causing the insertion end 511 to be pulled out of the locking hole 201. After the pull rod 513 moves to the position of the unlocking protrusion 54, the pull rod 513 is rotated, such that the pull rod 513 abuts against a side of the unlocking protrusion 54 facing away from the locking hole 201. Thus, the pull rod 513 drives the insertion end 511 to separate from the locking hole 201. FIGS. 8 and 9 are schematic diagrams of a folding process of the iron frame of the three-section sofa bed in the present disclosure. As shown in the figures, when the front sofa cushion S1 is folded and stored inside the sofa frame S10 through the linkage rotation of the first link 21 and the second link 22, the bearing segment 211 of the first link 21 drives the pull rod 513 of the locking rod 51 to separate from the unlocking protrusion 54. The first elastic member 53 drives the insertion end 511 of the locking rod 51 to reset. The reset state here refers to a state when the insertion end 511 of the locking rod 51 is inserted into the locking hole 201.

As shown in FIG. 3, the second link assembly 3 includes third link 31. One end of the third link 31 is pivoted to the middle segment of the first link 21, and the other end of the third link 31 is pivoted to the middle sofa cushion S2. The middle sofa cushion S2 is pivoted to a middle segment of the second link 22. As shown in FIG. 1, a lower end of the third link 31 is pivoted to the middle segment of the first link 21, and an upper end of the third link 31 is pivoted to the second iron frame S21. Through the third link 31, the first link 21 and the second link 22 drive the middle sofa cushion S2 to be folded and stored inside the sofa frame S10 or unfolded at one side of the rear sofa cushion S3.

As shown in FIGS. 3 and 5, the third link assembly 4 includes fourth link 41 and fifth link 42. The fourth link 41 and the fifth link 42 correspond and are parallel to each other. One end of the fourth link 41 and one end of the fifth link 42 are pivoted to the rear sofa cushion S3. As shown in FIG. 1, an upper end of the fourth link 41 and an upper end of the fifth link 42 are pivoted to the third iron frame S31. The other end of the fourth link 41 is pivoted to a pivot position of the second link 22 pivoted to the fixed base frame S101. The other end of the fifth link 42 is pivoted to the fixed base frame S101. Through the linkage rotation of the fourth link 41 and the fifth link 42, the second link assembly 3 drives the rear sofa cushion S3 to rise and fall.

Figure 10:
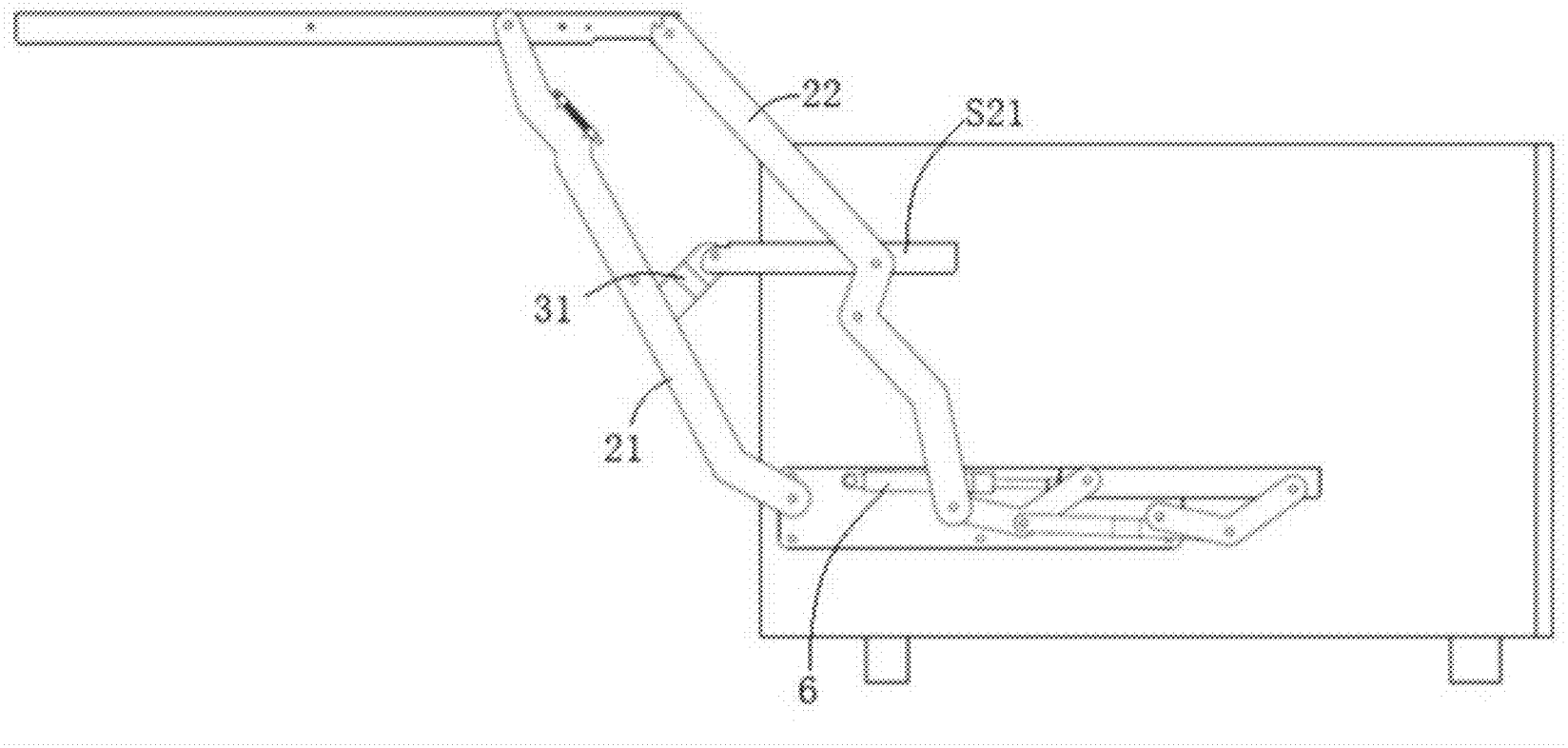
FIG. 10 is a side view of the iron frame of the three-section sofa bed in a semi-unfolded state according to the present disclosure.

FIG. 10 is a side view of the iron frame of the three-section sofa bed in a semi-unfolded state according to the present disclosure. As shown in FIGS. 10 and 2 to 4, in this implementation, the linkage mechanism 1 for a three-section sofa bed further includes second elastic member 6. One end of the second elastic member 6 is pivoted to the fixed base frame S101, and the other end of the second elastic member 6 is pivoted to the rear sofa cushion S3. The second elastic member is configured to provide assistance when the front sofa cushion S1 is folded and stored, or unfolded. As shown in FIG. 2, one end of the second elastic member 6 is pivoted to a left side of the fixed base frame S101, and the other end of the second elastic member 6 is pivoted to a left side of the rear sofa cushion S3. When the linkage mechanism 1 is in an unfolded state, the second elastic member 6 is in a compressed state, providing assistance for the storage of the linkage mechanism 1. As shown in FIGS. 3 and 10, when the linkage mechanism 1 is folded to a semi-unfolded state, the second elastic member 6 is in a non-stressed state and compresses again as the linkage mechanism 1 continues to be folded. As shown in FIG. 4, when the linkage mechanism 1 is in a folded state, the second elastic member 6 is in a compressed state, providing assistance for the unfolding of the linkage mechanism 1. The second elastic member 6 is a gas spring.

In summary, the present disclosure provides a linkage mechanism for a three-section sofa bed. The front sofa cushion is folded and stored inside the sofa frame or unfolded at one side of the middle sofa cushion through the linkage rotation of the first link assembly. The first link assembly drives the second link assembly, allowing the middle sofa cushion to be folded and stored inside the sofa frame or unfolded at one side of the rear sofa cushion, and drives the third link assembly, allowing the rear sofa cushion to rise and fall. The design realizes the one-step unfolding or folding of the three-section sofa bed, featuring easy operation, small structural volume, and low logistics costs. After the front sofa cushion is unfolded, the insertion end of the locking rod of the locking assembly is inserted into the locking hole to prevent the first link assembly from rotating again, thereby locking the linkage mechanism. The design prevents the front sofa cushion from being folded due to excessive loads of the middle sofa cushion and the rear sofa cushion, greatly improving product safety. Meanwhile, in the present disclosure, the linkage mechanism for a three-section sofa bed adopts the mounting form of three linkage assemblies, reducing packaging space and facilitating transportation.

It should be noted that terms "including", "comprising" or any other variants thereof are intended to cover non-exclusive inclusion such that a process, method, article, or apparatus including a series of elements includes not only those elements but also other elements not explicitly listed, or elements inherent to such a process, method, article, or apparatus. Without further limitation, an element qualified by the phrase "including a . . . " does not exclude the presence of an additional identical element in the process, method, article, or apparatus including the element.

The embodiments of the present disclosure have been described above with reference to the drawings, but the present disclosure is not limited to the foregoing specific embodiments. The foregoing specific embodiments are only illustrative and not restrictive. Under the inspiration of the present disclosure, those of ordinary skill in the art can make many improvements without departing from the purpose of the present disclosure and the protection scope defined by the claims, and these improvements shall fall within the protection scope of the present disclosure.

What is claimed is:

1. A linkage mechanism for a three-section sofa bed, comprising:

a first link assembly, comprising a first side pivoted to a front sofa cushion and a second side pivoted to a fixed base frame of a sofa frame, wherein the first link assembly is provided with a locking hole; and the front sofa cushion is folded and stored inside the sofa frame or unfolded at a side of a middle sofa cushion through a linkage rotation of the first link assembly;

a second link assembly, comprising a first end pivoted to the middle sofa cushion and a second end pivoted to a middle segment of the first link assembly, wherein the first link assembly drives the second link assembly to rotate, wherein the middle sofa cushion is allowed to be folded and stored inside the sofa frame or unfolded at a side of a rear sofa cushion;

a third link assembly, comprising a first side pivoted to the rear sofa cushion and a second side pivoted to a pivot position of the first link assembly pivoted to the fixed base frame, wherein the first link assembly drives the third link assembly to rotate, wherein the rear sofa cushion is allowed to rise and fall; and a locking assembly, located at a side of the first link assembly adjacent to the front sofa cushion and comprising a locking rod, wherein the locking rod corresponds to the locking hole; and when the front sofa cushion is unfolded at the side of the middle sofa cushion through the linkage rotation of the first link assembly, an insertion end of the locking rod of the locking assembly is inserted into the locking hole to prevent the first link assembly from rotating again.

2. The linkage mechanism for the three-section sofa bed according to claim 1, wherein the first link assembly comprises:

a first link, comprising a first end pivoted to the front sofa cushion and a second end pivoted to the fixed base frame, wherein the locking assembly is located at a side of the first link adjacent to the front sofa cushion; and a second link, corresponding to the first link and comprising a first end pivoted to the front sofa cushion and a second end pivoted to the fixed base frame, wherein the locking hole is located on the second link; the front sofa cushion is folded and stored inside the sofa frame or unfolded at the side of the middle sofa cushion through a linkage rotation of the first link and the second link; and when the front sofa cushion is unfolded at the side of the middle sofa cushion, the insertion end of the locking rod of the locking assembly is inserted into the locking hole to prevent the first link and the second link from rotating.

3. The linkage mechanism for the three-section sofa bed according to claim 2, wherein when the front sofa cushion is unfolded at the side of the middle sofa cushion through the linkage rotation of the first link and the second link, the side of the first link adjacent to the front sofa cushion is provided with a bearing segment, wherein the bearing segment extends along a length direction of the front sofa cushion; the locking assembly is located on the bearing segment; a pivot end of the second link pivoted to the front sofa cushion extends along the length direction of the front sofa cushion; and the locking hole is located at an end of the second link adjacent to the locking assembly.

4. The linkage mechanism for the three-section sofa bed according to claim 3, wherein the locking assembly comprises a fixed member and a first elastic member; the fixed member is fixedly provided on the bearing segment; the locking rod is threaded through the fixed member; the locking rod is provided with a stop member adjacent to a side of the insertion end of the locking rod; the first elastic member is sleeved on the locking rod; two ends of the first elastic member abut against the stop member and the fixed member, respectively; and the first elastic member is configured to drive the insertion end of the locking rod to be inserted into the locking hole.

5. The linkage mechanism for the three-section sofa bed according to claim 4, wherein two sides of the locking hole of the second link are arc-shaped; when the front sofa cushion is unfolded at the side of the middle sofa cushion through the linkage rotation of the first link and the second link, the insertion end of the locking rod slides into the locking hole through arc-shaped segments at the two sides of the locking hole of the second link.

6. The linkage mechanism for the three-section sofa bed according to claim 4, wherein the locking assembly further comprises an unlocking protrusion; the unlocking protrusion is located on the front sofa cushion and corresponds to the locking rod; an end of the locking rod opposite to the insertion end is provided with a pull rod; the pull rod abuts against a side of the unlocking protrusion facing away from the locking hole; and the pull rod drives the insertion end to separate from the locking hole.

7. The linkage mechanism for the three-section sofa bed according to claim 6, wherein when the front sofa cushion is folded and stored inside the sofa frame through the linkage rotation of the first link and the second link, the bearing segment of the first link drives the pull rod of the locking rod to separate from the unlocking protrusion; and the first elastic member drives the insertion end of the locking rod to reset.

8. The linkage mechanism for the three-section sofa bed according to claim 2, wherein the second link assembly comprises a third link; the third link comprises a first end pivoted to the middle segment of the first link and a second end pivoted to the middle sofa cushion; the middle sofa cushion is pivoted to a middle segment of the second link; and through the third link, the first link and the second link drive the middle sofa cushion to be folded and stored inside the sofa frame or unfolded at the side of the rear sofa cushion.

9. The linkage mechanism for the three-section sofa bed according to claim 2, wherein the third link assembly comprises a fourth link and a fifth link; the fourth link and the fifth link correspond and are parallel to each other; a first end of the fourth link and a first end of the fifth link are pivoted to the rear sofa cushion; a second end of the fourth link is pivoted to a pivot position of the second link pivoted to the fixed base frame; a second end of the fifth link is pivoted to the fixed base frame; and through a linkage rotation of the fourth link and the fifth link, the second link assembly drives the rear sofa cushion to rise and fall.

10. The linkage mechanism for the three-section sofa bed according to claim 1, further comprising a second elastic member, wherein the second elastic member comprises a first end pivoted to the fixed base frame and a second end pivoted to the rear sofa cushion; and the second elastic member is configured to provide assistance when the front sofa cushion is folded and stored, or unfolded.

* * * * *